United States Patent [19]

Archer

[11] Patent Number: 4,570,809

[45] Date of Patent: Feb. 18, 1986

[54] CHILD PROOF CAP HAVING TAMPER MEANS

[76] Inventor: David Archer, 6, Higham Stn. Ave., Chingford, London E4 9 AZ, England

[21] Appl. No.: 659,822

[22] Filed: Oct. 5, 1984

[51] Int. Cl.[4] ..... B65D 55/02

[52] U.S. Cl. ..... 215/220; 215/256

[58] Field of Search ..... 215/220, 250, 253, 256

[56] References Cited

U.S. PATENT DOCUMENTS 4,433,789 2/1984 Gibilisco ..... 215/220

*Primary Examiner*—George T. Hall

*Attorney, Agent, or Firm*—Berman, Aisenberg & Platt

[57] ABSTRACT

A closure cap for a container comprises an inner cap which can be screwed onto the neck of a bottle, and an outer cap which covers and surrounds the inner cap. The outer cap has a tamper evident rim part of which extends into an annular groove in the inner cap. Portions on the top of the inner cap can be brought into engagement with portions provided under the top of the outer cap following downward movement of the outer cap. This downward movement of the outer cap enables rotation of the outer cap to effect removal of the cap, but such downward movement is only possible after the tamper evident rim has been removed.

8 Claims, 2 Drawing Figures

CHILD PROOF CAP HAVING TAMPER MEANS

Figure 1:
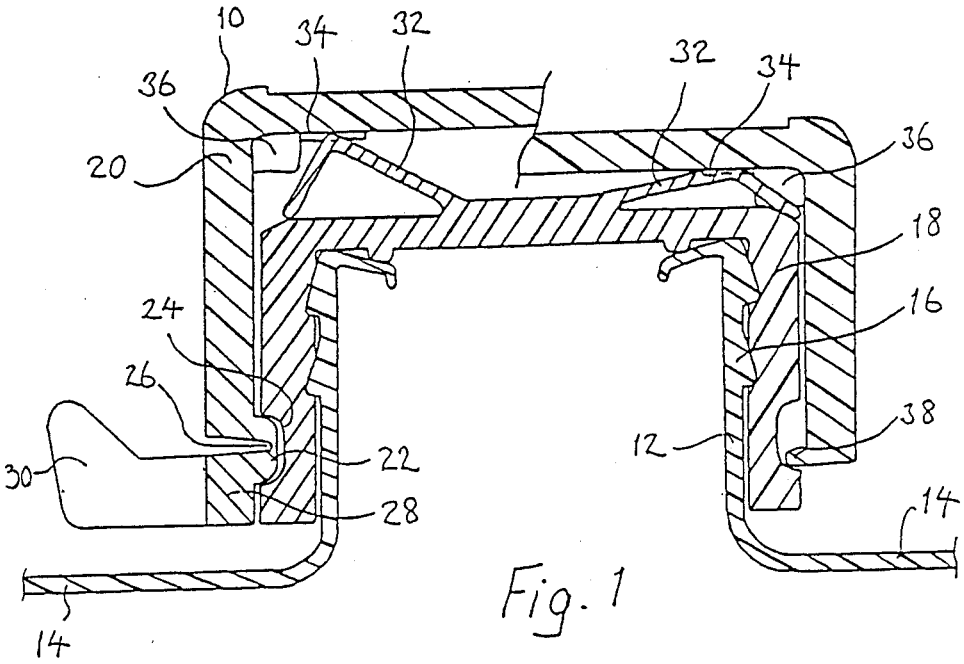

The present invention relates to a closure cap for a container, which may for example contain medicinal tablets or pills which may be harmful to children, the closure cap being so constructed that it is difficult for a child to remove it from a container.

One form of cap which has already been proposed comprises an inner cap part which is screw-threaded to engage the external screw-threading on the neck of a bottle, and an outer cap which surrounds the inner cap. The underside of the outer cap has a number of dogs around its periphery which engage corresponding dogs on the upper side of the inner cap to allow the latter to be unscrewed from the neck of the bottle. To bring about such engagement, the outer cap has to be pressed downwardly in relation to the inner cap against the force of a number of resilient tongues which slant downwardly from the underside of the outer cap. Thus the whole cap can only be removed if the outer cap is pressed downwardly. Screwing the whole cap onto the neck of the bottle is easier, however, because the resilient tongues engage ramp portions on the upper side of the inner cap in the manner of a ratchet. Thus, if a young child should play with the bottle, he or she is unlikely to unscrew the cap as this requires continued downward pressure on the outer cap combined with an unscrewing action, and should the cap be somewhat loose on the bottle, the child will tend to tighten the cap rather than unscrew it because of the ratchet effect.

Such a cap suffers the disadvantage that no evidence is provided that the bottle has been tampered with prior to sale to removal of the cap. Also, the resilient tongues cannot be used to effect unscrewing of the cap, and a completely different set of parts of the cap is used for unscrewing the cap from the parts which are used for screwing the cap up. This results in a relatively complex structure to manufacture. A further disadvantage is that the maintenance of the resilient force exerted by the tongues on the outer cap is dependent upon the permanence of one bend in the plastics, namely at the point where the resilient tongue joins the underside of the outer cap.

The present invention seeks to overcome one or more of the foregoing disadvantages. Accordingly, the present invention is directed to a closure cap for a container comprising a first part which engages a neck portion or other otherwise open end of a container when the cap is in use, a second part which is mounted on the first part so as to be moveable in relation thereto, engagement means of the first and second parts arranged to enable the cap to be removed from the container by means of the second part following a relative movement between the two parts, and a removeable tamper evident portion on one of the said first and second parts which engages a portion of the other of the said first and second parts thereby to obstruct such relative movement until it is removed.

The cap may be provided with at least one displaceable portion, which is displaced by a relative movement between two parts of the cap, and which is used to enable the cap to be unscrewed from the neck of a container. Such a cap may comprise a screw-threaded part which can be screwed onto a neck portion or other otherwise open end of a container when the cap is in use, a second part which is mounted on the screw-threaded part so as to be rotatable in relation thereto, and also so as to be axially moveable in relation thereto, and engagement means comprising at least one displaceable portion on one of the two parts which displaceable portion is displaced by such relative axial movement, and at least one dog on the other part which engages the displaceable portion, following such relative axial movement, to enable the first part to be unscrewed from the neck or other end of the container by rotation of the second part. At least one further dog may be provided on the said other part to engage the displaceable portion in the manner of a ratchet and enable the cap to be screwed onto the neck or other end of the container.

In one simple form of such a closure cap, the or each displaceable portion is resilient and is V-shaped or otherwise bent or curved, the displacement being a lateral extension by flattening of the displaceable portion. If the or each displaceable portion is V-shaped, with one end of one of its arms being integral with the top of the screw-threaded part, it provides the advantage that the resilient force that it exerts between the screw-threaded part and the second part is dependent upon the permanance of two portions, namely that where the displaceable portion joins the screw-threaded part, and also the apex or elbow of the "V".

Preferably the screw-threaded part is an inner cap and the second part is an outer cap which covers and surrounds the inner cap. The engagement means may then be on the top of the inner cap and on the underside of the outer cap. With a closure cap provided with a tamper evident portion, the latter may be a strip forming the lower rim of the outer cap and engaging an annular groove or recess formed around the outside of the inner cap adjacent to the rim thereof.

Figure 2:
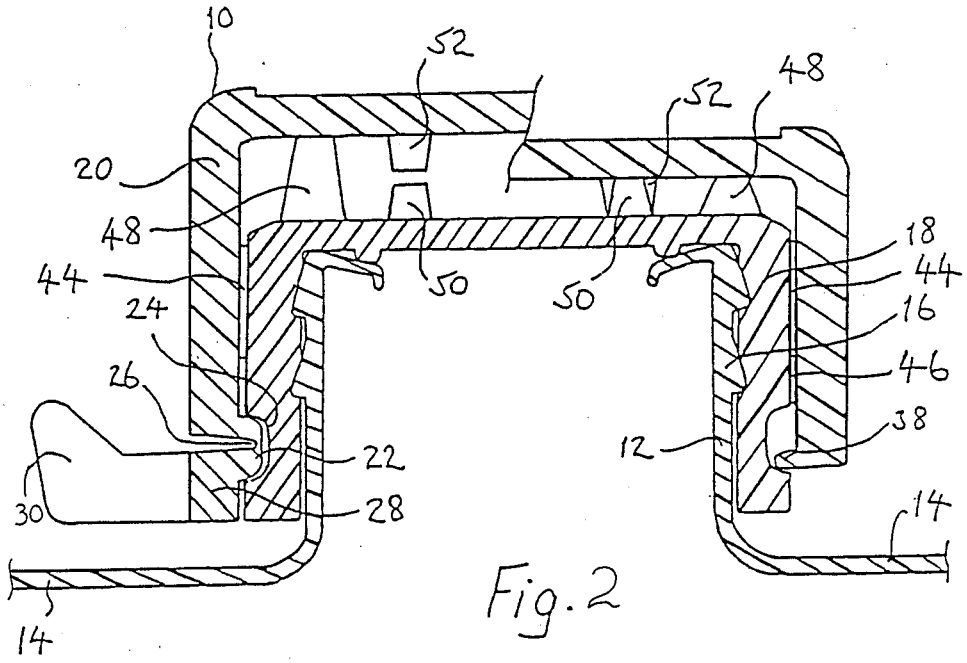

Examples of closure caps made in accordance with the present invention are illustrated in the accompanying drawing in which FIG. 1 shows an axial sectional view of a cap on a neck of a bottle, and FIG. 2 shows sectional views of respective modifications.

A cap 10 is shown screwed onto the neck 12 of a bottle only the shoulders 14 of which are shown in FIG. 1. The neck 12 has external screw-threading 16, and an internal part 18 of the cap is internally screw-threaded to effect engagement with the neck 12. An outer part 20 of the cap covers and surrounds the inner part 18, and forms a loose fit therewith so that the outer part 20 can be rotated in relation to the inner part 18 about an axis of the cap.

An annular lower portion 22 of the outer part 20 protrudes inwardly, and is accommodated by an annular recess or groove 24 formed around the outside of the inner part 18, close to the rim thereof. The inwardly projecting part 22 of the outer part 20 is pinched at a central part 26 thereof to form a very thin tearable bridging portion between the main part of the outer part 20 and the rim 28 thereof. The latter is therefore fairly easily removed from the rest of the outer part 20, and forms a tamper evident strip part of which is received by the groove or recess 24 in the inner part 18. A tab 30 which is integral with and projects outwardly from the rim 28 is provided to facilitate tearing off of the latter.

Four inverted V-shaped tongues 32 (only two of which are shown in the drawing) are equi-angularly spaced around the top of the inner part 18. The tongues extend outwardly from a central part of the top of the inner part 18, and are integral therewith, so that the apex or elbow of the V-shaped tongue abuts the underside of the outer part 20, and the free end of the tongue rests against the top of the inner part 18. Each tongue is sufficiently resilient to enable downward hand pressure on the outer part 20 relative to the inner part 18 to flatten the tongues, and to extend them outwardly.

A first set of dogs 34 are in the form of flaps which slant downwardly. These are positioned with equiangularly spacing around the underside of the outer part 20 in register with the elbows or apices of the tongues 32 so as to form a ratchet therewith. A further set of four dogs 36 extend inwardly from the corner between the sides and the top of the outer part 20. These are also arranged to be in register with the tongues 32 but do not normally overlap therewith as viewed from a side thereof.

The cap operates as follows.

The whole cap can very simply be screwed onto the neck of the bottle by clockwise rotation of the outer part 20 in view of the ratchet engagement of the dogs 34 on the tongues 32 of the inner part 18. Any attempt now to unscrew the cap from the bottle by rotation of the outer part 20 will fail because the ratchet formed between the dogs 34 and the tongues 32 allows anticlockwise rotation of the outer part 20 in relation to the inner part 18. As will be described later, the cap can only be removed by downward axial movement of the outer part 20 in relation to the inner part 18. This however is prevented because the tamper evident strip or rim 28, extending as it does into the recess or groove 24, obstructs such downward axial movement. Only after the tab 30 has been gripped and the strip 28 torn off can the outer part 20 be axially downwardly moved in relation to the inner part 18, as shown in the right-hand side of the drawing. This downward movement flattens the tongues 34 so that they extend further outwardly, and at the same time the dogs 36 are lowered in relation to the tongues 32. Each tongue 32 and dog 36 now overlap as viewed from one side thereof, and anticlockwise rotation of the outer part 20 will bring about engagement between the dogs 36 and the associated tongues thereby enabling the inner part 18 to be unscrewed from the neck 12 by rotation of the outer part 20. The resilient tongues 32 will restore the original relative positioning between the two parts 18 and 20 once downward pressure on the outer part 20 is removed.

The cap can be replaced quite simply by clockwise rotation of the outer part 20 without downward pressure thereon in view of the ratchet engagement of the dogs 34 on the tongues 32.

A further removal of the cap from the bottle can again only be effected by downward pressure on the outer part 20. However it will now be evident from the absence of the tamperproof strip 28 that a first removal of the cap from the bottle has already taken place.

The outer part 20 cannot be removed from the inner part 18 because a residual portion 38 of the inwardly projecting part 22, after the strip or rim 28 has been removed, still projects into the recess or groove 24.

The inner and outer part of the cap may be made by injection moulding polypropolene synthetic plastics material, the dogs and resilient tongues being made integral therewith.

Numerous variations and modifications to the construction of the cap illustrated in the drawing will readily occur to the reader without taking the cap outside the scope of the present invention. For example, evident strip 40 can be provided as the rim of the inner part 18 instead of the outer part 20, as shown in FIG. 2. In this way, it still obstructs downward axial movement of the tongue 32 could be provided on the lower side of the outer part 20 with the dogs 34 and 36 provided instead on the top of the inner part 18.

In the modification shown in FIG. 2, there are no V-shaped tongues 32, or dogs 34 and 36. Instead, the functions of those parts are performed by ratchet projections 44 and 46 on the inner and outer cap parts 18 and 20 respectively, by straight resilient tongues 48 that project upwardly on a slant from the top of the outer cap part 20, and by castellations 50 and 52 projecting respectively upwardly from the top of the inner cap part 18 and downwardly from the underside of the outer cap part 20.

When a cap as shown in FIG. 2 is initially screwed onto a container neck 12, the ratchet projections 44 and 46 interengage to prevent relative rotation between the inner and outer cap parts 18 and 20. Once the cap is firmly screwed on, it cannot be unscrewed merely by rotation of the outer cap part 20 in the reverse sense, because the ratchet projections do not firmly engage for that sense of rotation. The tamper evident strip 28 must be removed. The outer cap part 20 is then pressed downwardly against the resilience of the tongues 48 to engage the castellations 50 and 52, to enable rotation of the outer cap part 20 to unscrew the inner cap part 18 from the neck 12.

I claim:

1. A closure cap for a container comprising:

(a) an inner cap having an internal screw-thread which engages an externally screw-threaded otherwise open end of a container when the closure cap is in use;

(b) an outer cap which is mounted on said inner cap so as to cover and surround said inner cap and so as to be moveable in an axial direction in relation thereto;

(c) engagement means of said inner and outer caps arranged to enable the closure cap to be removed from the container by means of said outer cap following a relative axial movement between the inner and outer caps;

(d) a removeable tamper evident strip forming a lower rim of said outer cap; and (e) an annular groove around the outside of said inner cap which is engaged by said strip thereby to obstruct such relative axial movement until it is removed.

2. A closure cap according to claim 1, in which portions provided on one of said inner and outer caps are engageable with portions provided on the other in the manner of a ratchet.

3. A closure cap according to claim 2, in which the ratchet engagement is such as to enable said inner cap to be screwed on to such an otherwise open end of a container by rotation of said outer cap.

4. A closure cap according to claim 1, in which at least one resilient portion provided on one of said inner and outer caps resists such relative axial movement.

5. A closure cap according to claim 4, in which said at least one resilient portion is provided on the top of said inner cap and abuts the underside of the top of said outer cap.

6. A container having an open end which is closed by a closure cap as claimed in claim 1.

7. A closure cap for a container comprising:

(a) an inner cap having an internal screw-thread which engages an externally screw threaded otherwise open end of a container when the closure cap is in use;

(b) an outer cap which is mounted on said inner cap so as to cover and surround said inner cap so as to be moveable in an axial direction in relation thereto;

(c) engagement means of said inner and outer caps arranged to enable the closure cap to be removed from the container by means of said outer cap following a relative axial movement between the inner and outer caps;

(d) a removeable tamper evident strip forming a lower rim of said outer cap;

(e) an annular groove around the outside of said inner cap which is engaged by said strip thereby to obstruct such relative axial movement until it is removed;

(f) ratchet portions on the outside of the skirt portion of said inner cap and on the inside of the skirt portion of said outer cap, the ratchet portions of the inner and outer caps engaging one another in the manner of a ratchet such as to enable said inner cap to be screwed on to such an otherwise open end of a container by rotation of said outer cap, but such that rotation of said outer cap in the opposite sense merely results in those portions sliding over one another.

8. A closure cap for a container comprising:

(a) an inner cap having an internal screw-thread which engages an externally screwthreaded otherwise open end of a container when the closure cap is in use;

(b) an outer cap which is mounted on said inner cap so as to cover and surround said inner cap so as to be moveable in an axial direction in relation thereto;

(c) engagement means of said inner and outer caps arranged to enable the closure cap to be removed from the container by means of said outer cap following a relative axial movement between the inner and outer caps;

(d) a removeable tamper evident strip forming a lower rim of said outer cap;

(e) an inwardly protruding portion at the junction between said tamper evident strip and the rest of said outer cap;

(f) an annular groove around the outside of said inner cap which is engaged by said inwardly protruding portion to obstruct such relative axial movement; and (g) a region of said inwardly protruding portion of reduced cross section, which allows said tamper evident strip to be torn away from the rest of said outer cap to permit such relative axial movement.

* * * * *